US011297698B1

(12) United States Patent
Xiong

(10) Patent No.: US 11,297,698 B1
(45) Date of Patent: Apr. 5, 2022

(54) CONSTANT CURRENT LED DRIVER WITH LIGHT OUTPUT MODULATION

(71) Applicant: Universal Lighting Technologies, Inc., Madison, AL (US)

(72) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 929 days.

(21) Appl. No.: 16/040,753

(22) Filed: Jul. 20, 2018

Related U.S. Application Data

(60) Provisional application No. 62/538,009, filed on Jul. 28, 2017.

(51) Int. Cl.
*H05B 45/14* (2020.01)
*H05B 45/3725* (2020.01)
*H05B 45/355* (2020.01)

(52) U.S. Cl.
CPC ..... *H05B 45/14* (2020.01); *H05B 45/355* (2020.01); *H05B 45/3725* (2020.01)

(58) Field of Classification Search
CPC .... H05B 45/14; H05B 45/325; H05B 45/335; H05B 45/3725; H05B 45/355; H05B 45/37; H05B 47/105; H05B 45/32–347
See application file for complete search history.

(56) References Cited

U.S. PATENT DOCUMENTS 5,696,431 A 12/1997 Giannopoulos et al.
7,843,141 B1 11/2010 Xiong et al.
9,112,415 B2 8/2015 Grakist et al.
9,237,613 B1 1/2016 Xiong et al.
2008/0224636 A1* 9/2008 Melanson ..... H05B 45/38 315/307
2010/0149838 A1 6/2010 Artusi et al.
2012/0026759 A1 2/2012 Balakrishnan et al.
2013/0271021 A1 10/2013 Elferich
2013/0300310 A1 11/2013 Hu
2014/0091720 A1 4/2014 Brinlee
2014/0152187 A1 6/2014 Lin et al.
2014/0239840 A1* 8/2014 Wang ..... H05B 45/10 315/224
2014/0346874 A1 11/2014 Fang et al.
2015/0042227 A1 2/2015 Kumar et al.
2015/0257222 A1 9/2015 Siessegger et al.
(Continued)

*Primary Examiner* — Abdullah A Riyami
*Assistant Examiner* — Syed M Kaiser
(74) *Attorney, Agent, or Firm* — Patterson Intellectual Property Law, P.C.

(57) ABSTRACT

An LED driver for light modulation control includes a power converter circuit having a controller, a buffer circuit, and an energy recovery circuit. The controller is configured to selectively enable and disable both buffer control signals and gate drive signals depending on a sensed modulation control signal corresponding to a modulation-on stage and a modulation-off stage. In the modulation-on stage, the buffer control signals are enabled and the gate drive signals are disabled. In the modulation-off stage, the buffer control signals are disabled and the gate drive signals are enabled. The buffer circuit is configured for quick turn off of an LED load and for temporary storage of power from an output capacitor. The energy recovery circuit is configured to reuse the power stored in the buffer circuit before relying on an external power source to power the controller.

18 Claims, 8 Drawing Sheets

(56) References Cited

U.S. PATENT DOCUMENTS

| | | | | |
|---|---|---|---|---|
| 2016/0014858 | A1 | 1/2016 | Ramabhadran et al. | |
| 2016/0044753 | A1* | 2/2016 | Lee | H03K 7/08<br>315/185 R |
| 2016/0073457 | A1 | 3/2016 | Nakajo | |
| 2016/0190945 | A1 | 6/2016 | Liu et al. | |
| 2018/0317292 | A1* | 11/2018 | Katsura | H05B 45/38 |
| 2019/0032864 | A1* | 1/2019 | Xiong | F21K 9/272 |
| 2020/0271279 | A1* | 8/2020 | Xiong | F21V 3/061 |

* cited by examiner

CONSTANT CURRENT LED DRIVER WITH LIGHT OUTPUT MODULATION

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of U.S. Provisional Patent Application No. 65/538,009 filed Jul. 28, 2017, entitled "Constant Current LED Driver with Light Output Modulation," and which is hereby incorporated by reference.

FIELD OF THE INVENTION

The present invention relates generally to dimming power supplies such as LED drivers for lighting systems. More particularly, the present invention relates to fast and lossless output current modulation of constant current LED drivers.

BACKGROUND

Modulation of the lighting output from light emitting diodes (LEDs) can be used for wireless communication with external devices, for example to communicate the status of components in a lighting device, for device commissioning, etc. However, it is difficult to modulate the output of a constant output current type LED driver, which is the most popular type of LED driver currently used in the market. Generally speaking, there are two types of constant current dimmable LED drivers in the market: pulse width modulation (PWM) output and analog constant output. The analog constant output type of LED driver has a much better flickering index as compared with the PWM output type, at least because the analog output type driver always has constant DC current.

Constant current control typically requires at least two signals to maintain a certain current level, a sensed output current (feedback) signal and a reference signal. The output current signal is compared with the reference signal and fed back into the driver for control adjustments (e.g., to switching frequency or duty ratio) in order to maintain the certain current level.

According to a typical current feedback control scheme as represented in FIG. 1, an exemplary constant current LED driver 100 includes a power converter 102 which receives power from a first voltage source 104. The first voltage source 104 may be a direct current (DC) voltage source, as an output from a DC energy storage device, a bridge rectifier, power factor correction (PFC) circuit, or the like. The power converter 102 includes at least a gate drive integrated circuit (IC) 106, a switch 108, and a power tank 110. The power tank 110 could either be a frequency controlled type converter (e.g., a half-bridge type) or a duty-ratio controlled type converter (e.g., buck-boost or flyback type). The power converter 102 includes an LED load 114 coupled between a first output terminal 116 and second output terminal 118 of the power converter 102, at respective load input 120 and output terminals 122.

The LED driver 100 further includes a current sensing resistor 124 which is configured to sense the current going through the LED load 114. The current sensing resistor 124 in the present example is coupled between the second output terminal 118 of the power converter 102 and the load output terminal 122. The second output terminal 118 of the power converter 102 may be coupled to earth ground 126. The sensed current going through the LED load 114 may be referred to an output current 128 measured at the load output terminal 122.

In order to maintain a constant output current, the exemplary LED driver 100 includes a current proportional integral (PI) control loop 112 coupled between the load output terminal 122 and the power converter 102. The PI loop 112 includes an operational amplifier (OPAMP) 136 having an input current reference signal 138 coupled to a non-inverting input terminal 140 thereof. A first resistor 130 is coupled between the load output terminal 122 and an inverting input terminal 142 of the OPAMP 136, and a second resistor 132 is coupled in series with a capacitor 134 between the inverting input terminal 142 and an output terminal 144 of the OPAMP 136. The output terminal 144 of the OPAMP 136 is configured to output an error voltage signal 146 which is fed back to the power converter 102. The OPAMP 136 of the PI loop 112 further includes a positive voltage supply terminal 148 and a negative voltage supply terminal 150. The positive voltage supply terminal 148 is coupled to a second voltage source 152 at a first end 154 of the second voltage source 152. The second voltage source 152 includes a second end 156 coupled to earth ground 126. The negative voltage supply terminal 150 of the OPAMP 136 is coupled to earth ground 126.

The exemplary gate drive integrated circuit (IC) 106 of the power converter 102 has a voltage controlled oscillator (VCO) 158 or a comparator 160 coupled thereto. The VCO 158 or comparator 160 is configured to receive and transfer the error voltage signal 146 to either a frequency control input or duty-ratio control input, depending on the type of power tank 110 implemented. The frequency input or duty-ratio control input associated with the error voltage signal 146 is then sent to the gate drive IC 106 in order to control the switch 108.

When the input current reference signal 138 changes, the error voltage signal 146, the frequency control input or duty-ratio control input, and a frequency or a duty-ratio in power converter 102 will change accordingly in order to regulate the output current 128 to be the same as input current reference signal 138.

Otherwise stated, changes to the input current reference signal 138 will have an indirect but corresponding effect on the output current 128 passing through the LED load 114. However, one primary issue with this typical current feedback control scheme for a constant current LED driver 100 is that the PI loop 112 is slow. For example, the PI loop may typically have a crossover frequency less than 1 kHz, meaning that loop will ignore any disturbing signal with a frequency greater than 1 kHz. As a result of this limitation, it is impossible to modulate the output current 128 with a frequency greater than 1 kHz by changing the input current reference signal 138.

Referring next to an ideal LED output current modulating waveform 200 as illustrated in FIG. 2, an exemplary output current 128 is turned on and off according to the communication protocol. The rise time and fall time are each very sharp, which is ideal for a sensor to sense the modulation. There is also no overshoot at any time during the illustrated ideal current modulation.

However, as illustrated for example in FIG. 3, a more practical LED output current modulating waveform 300 will typically include a turn-off delay time 302, a turn-on delay time 304, and a turn-on overshoot current 306. An excessive turn-off delay time 302, turn-on delay time 304, and/or turn-on overshoot current 306 may negatively impact communication reliability and make the modulation practically useless. It is accordingly desirable to reduce the turn-off delay time 302, the turn-on delay time 304, and the turn-on overshoot current 306 as much as possible to ensure reliable communication based on LED output current modulation.

Referring next to FIG. 4, the LED load 114 may either be open- or short-circuited in order to achieve LED output current modulation. FIG. 4 depicts the current feedback control scheme for a constant current LED driver 100 as shown in FIG. 1 with the addition of an output capacitor 162, an open-circuit switch 164, and a short-circuit switch 166. The output capacitor 162 is coupled between the first output terminal 116 and the second output terminal 118 of the power converter 102. A first method of LED output current modulation is to couple the open-circuit switch 164 in series with the LED load 114. A second method of LED output current modulation is to couple the short-circuit switch 166 in parallel with the LED load 114. However, due to the PI loop 112 neither the first method nor the second method will work effectively, as further described herein.

In the case of the first method, when the open-circuit switch 164 is opened, the output current 128 through the LED load 114 will quickly fall to zero. The PI loop 112, however, will continually attempt to maintain a constant output current through the current sensing resistor 124 while the open-circuit switch 164 is open. As a result, all of the extra energy will be stored in the output capacitor 162, which causes a substantial voltage increase in the output capacitor 162. This voltage increase will in turn create a substantial turn-on current spike when the open-circuit switch 164 is closed.

In the case of the second method, when the short-circuit switch 166 is closed, the output current 128 through the LED load 114 will rapidly fall to zero. This is unfortunate and wasteful in that all of the energy stored in the output capacitor 162 will be rapidly discharged through the short-circuit switch 166. Due to the fact that the operation condition for the LED driver 100 changed from full load to zero load, it will take some time for the PI loop 112 to adjust and restart the LED load 114. Thus, implementation of the second method will result in a long turn-on delay.

One of skill in the art may appreciate that neither of these methods provide a good solution for overcoming the problems associated with LED output current modulation using a constant current LED driver 100.

BRIEF SUMMARY

Accordingly, it is desirable for various embodiments of a lighting device and method as disclosed herein to reduce turn-on delay time, turn-off delay time, current overshoot, and power loss during LED output current modulation.

Various embodiments of a lighting device and method as disclosed herein are provided with a novel gate drive controller design, having an integrated fast output modulating function and further configured thereby to modulate the lighting output without turn-on overshoot or turn-off delay.

Various embodiments of a lighting device and method as disclosed herein may further include an energy recovery stage which desirably enables energy recycling.

Various embodiments of a lighting device and method as disclosed herein may further programmatically "remember" and apply previous control information on the next device startup, or at the end of a modulation string, to desirably ensure quick startup without overshooting.

In a particular embodiment, an LED system for light modulation control as disclosed herein includes a power converter circuit configured to provide a constant current output. The power converter circuit comprises first and second output terminals, a power tank circuit, a switching circuit, and a gate drive controller, wherein the gate drive controller is configured to receive various inputs and selectively enable or disable gate drive signals to the switching circuit. A buffer circuit is coupled across the first and second output terminals of the power converter circuit, and is responsive to a buffer circuit signal from the gate drive controller to selectively store energy from an output capacitor coupled across the first and second output terminals of the power converter circuit. An energy recovery circuit is configured to power the gate drive controller from a selected one of the buffer circuit and a second voltage source of the energy recovery circuit.

In another embodiment, the gate drive controller is configured to receive a modulation control input, a reference input current, and a reference output current. The modulation control input is associated with a modulation-on stage, wherein the absence of the modulation control input is associated with a modulation-off stage. The reference output current is measured at one end of a load coupled to the first and second output terminals of the power converter circuit.

In an embodiment, the gate drive signals are disabled in the modulation-on stage to disable the power tank and stop further transfer of energy from the power converter circuit to the output capacitor and the buffer circuit, and the gate drive signals are enabled in the modulation-off stage to enable the power tank.

In another embodiment, the buffer circuit signal is enabled in the modulation-on stage and disabled in the modulation-off stage.

In another embodiment, the gate drive controller compares the reference input current with the reference output current to produce at least one of a frequency control signal and a duty-ratio control signal, and at least one of the frequency control signal and the duty-ratio control signal is transmitted to the switching circuit to control the reference output current.

In an embodiment, a load is coupled in series with a current sensing resistor between the first and second output terminals of the power converter circuit, and a reference output current measured by the current sensing resistor is fed back to the controller.

In another embodiment, the buffer circuit includes a buffer capacitor coupled to at least one buffer switch, the at least one switch enabled in response to receiving the buffer circuit signal from the controller. The buffer circuit operates as a short-circuit on a load and the output capacitor in response to the modulation-on stage, and the buffer capacitor stores energy discharged from the output capacitor in response to the modulation-on stage.

In a particular aspect of the aforementioned embodiment, the buffer capacitor may be at least five times the capacitance as the output capacitor.

In an embodiment, the energy recovery circuit is configured to selectively apply energy from either a buffer capacitor of the buffer circuit or the second voltage source to the controller. Energy from the buffer capacitor is utilized until depleted to a predetermined threshold voltage, and energy from the second voltage source is utilized once the buffer capacitor is discharged to the predetermined threshold voltage.

In a particular aspect of the aforementioned embodiment, the predetermined threshold voltage may be substantially equal to a voltage of the second voltage source.

DETAILED DESCRIPTION

Figure 1:
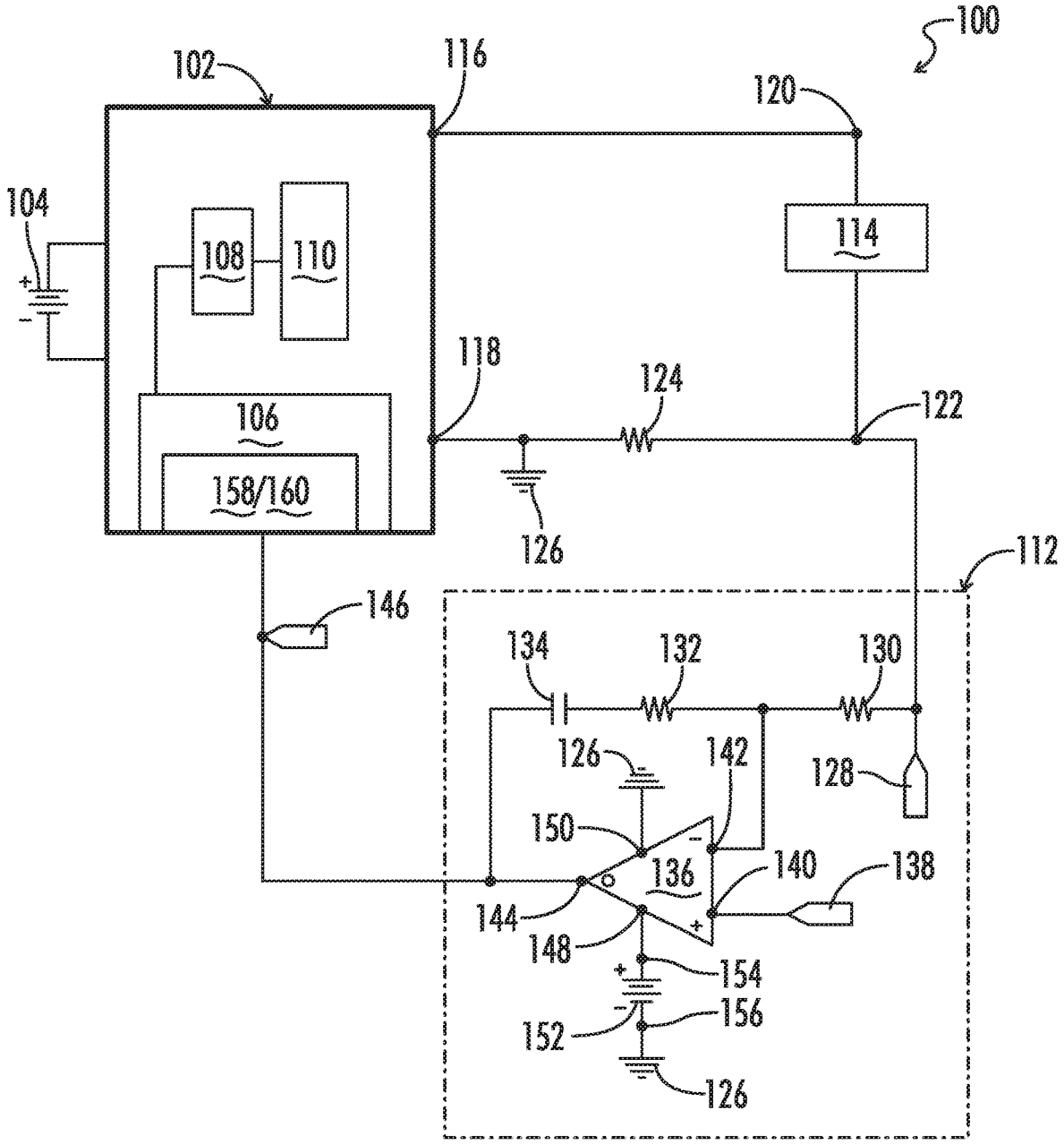
FIG. 1 (PRIOR ART)
FIG. 1 is a circuit block diagram representing a typical current feedback control scheme for a constant current LED driver.
Figure 2:
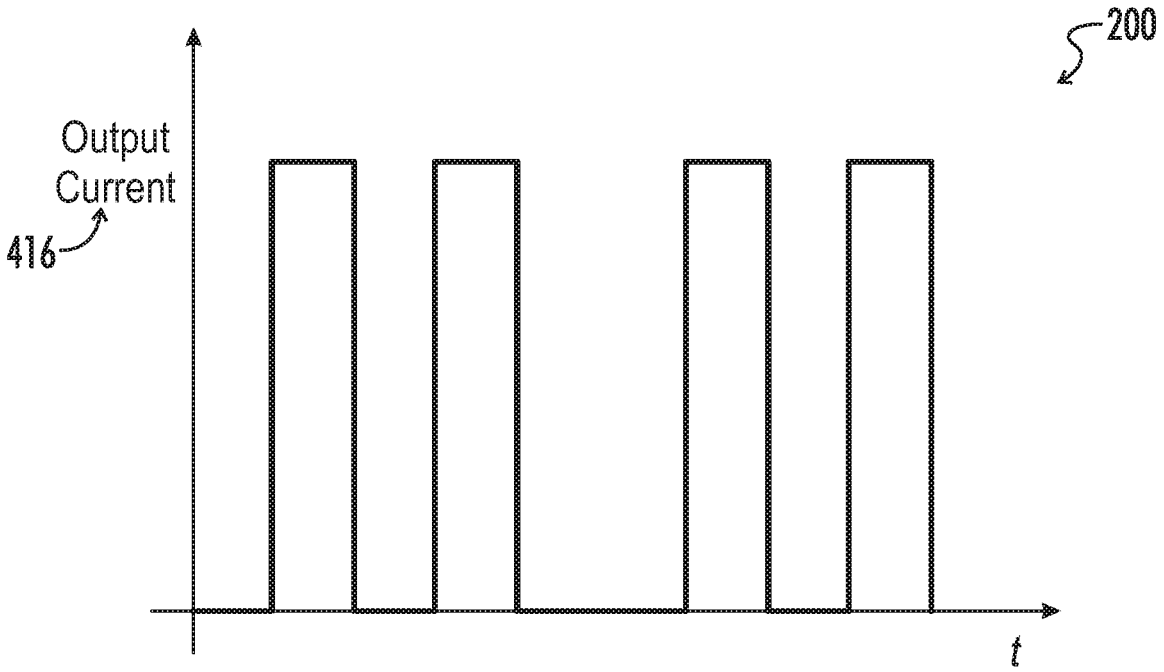
FIG. 2 (PRIOR ART)
FIG. 2 is a graphical diagram representing an ideal LED output current modulating waveform associated with the LED driver of FIG. 1.
Figure 3:
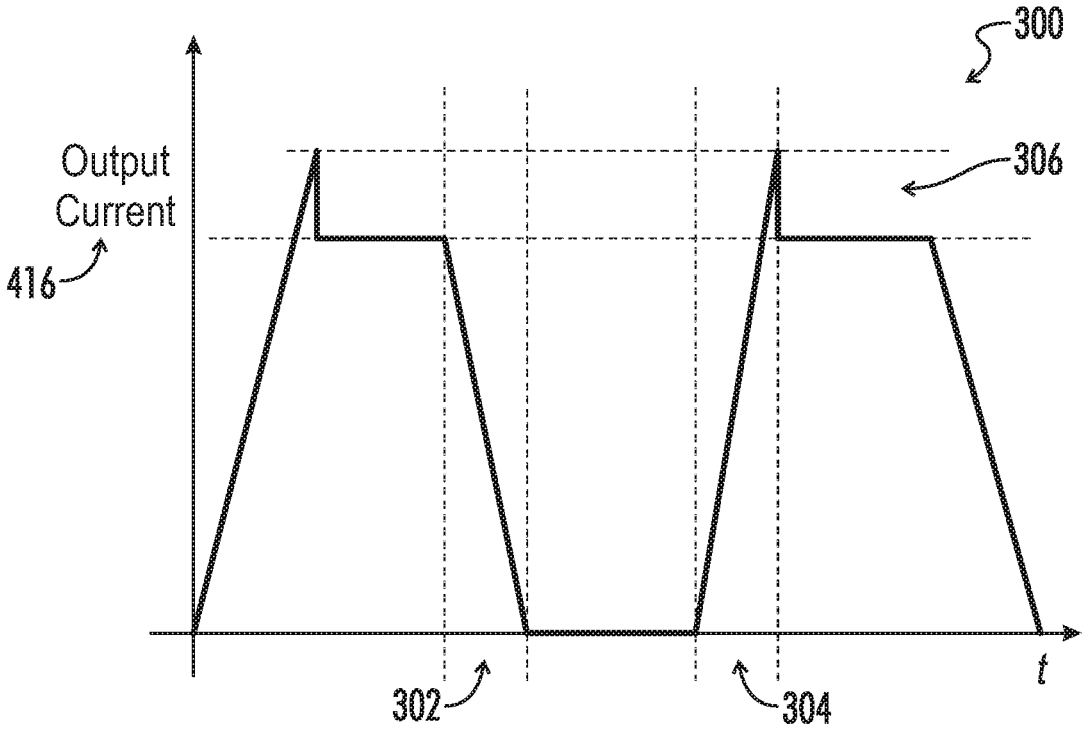
FIG. 3 (PRIOR ART)
FIG. 3 is a graphical diagram representing an actual LED output current modulating waveform associated with the LED driver of FIG. 1.
Figure 4:
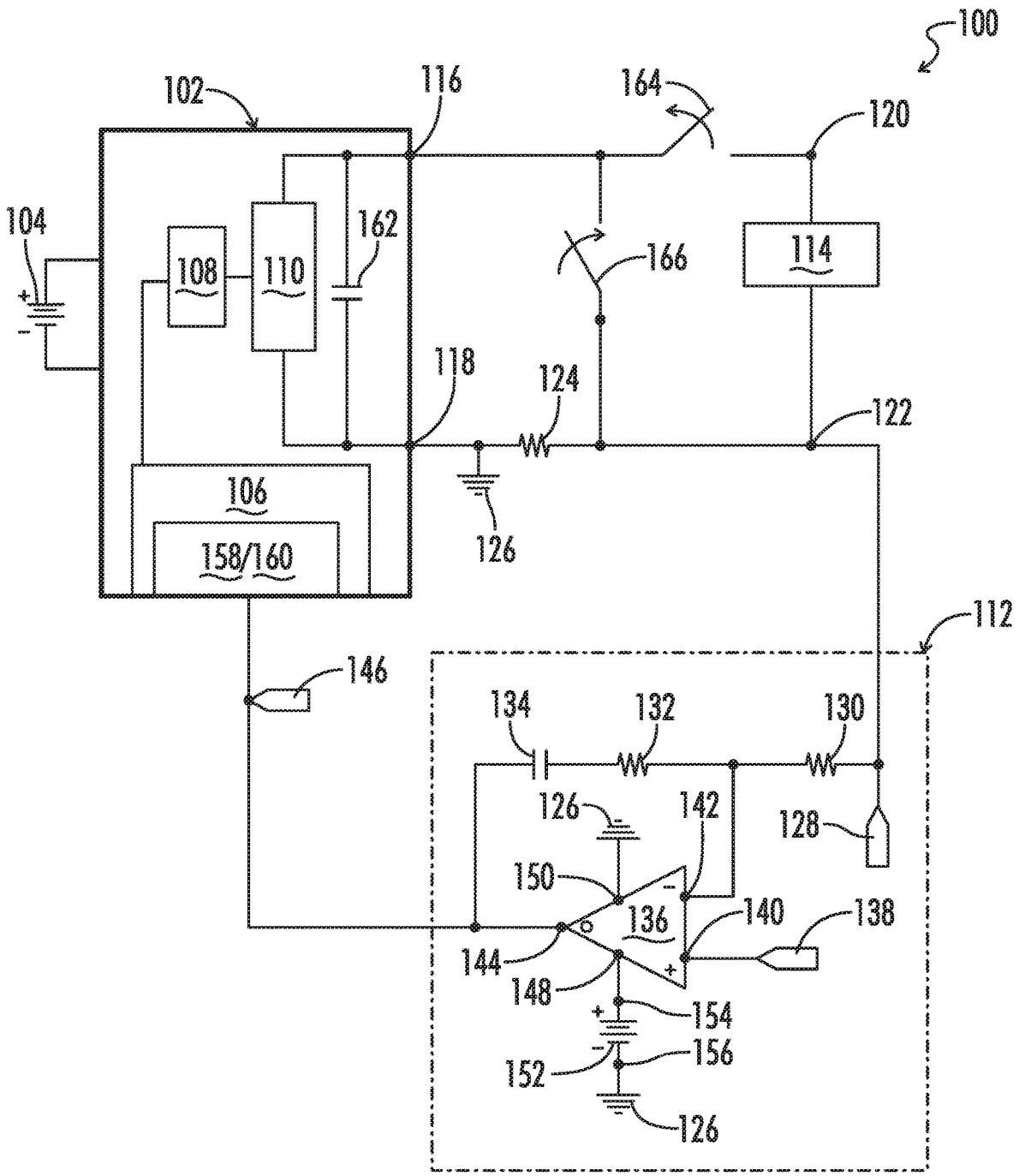
FIG. 4 (PRIOR ART)
FIG. 4 is a circuit block diagram representing two intuitive approaches for achieving LED output current modulation, a short-circuit switch and an open-circuit switch, utilizing the LED driver of FIG. 1.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention. Where the various figures may describe embodiments sharing various common elements and features with other embodiments, similar elements and features are given the same or similar reference numerals and redundant description thereof may be omitted below.

Figure 5:
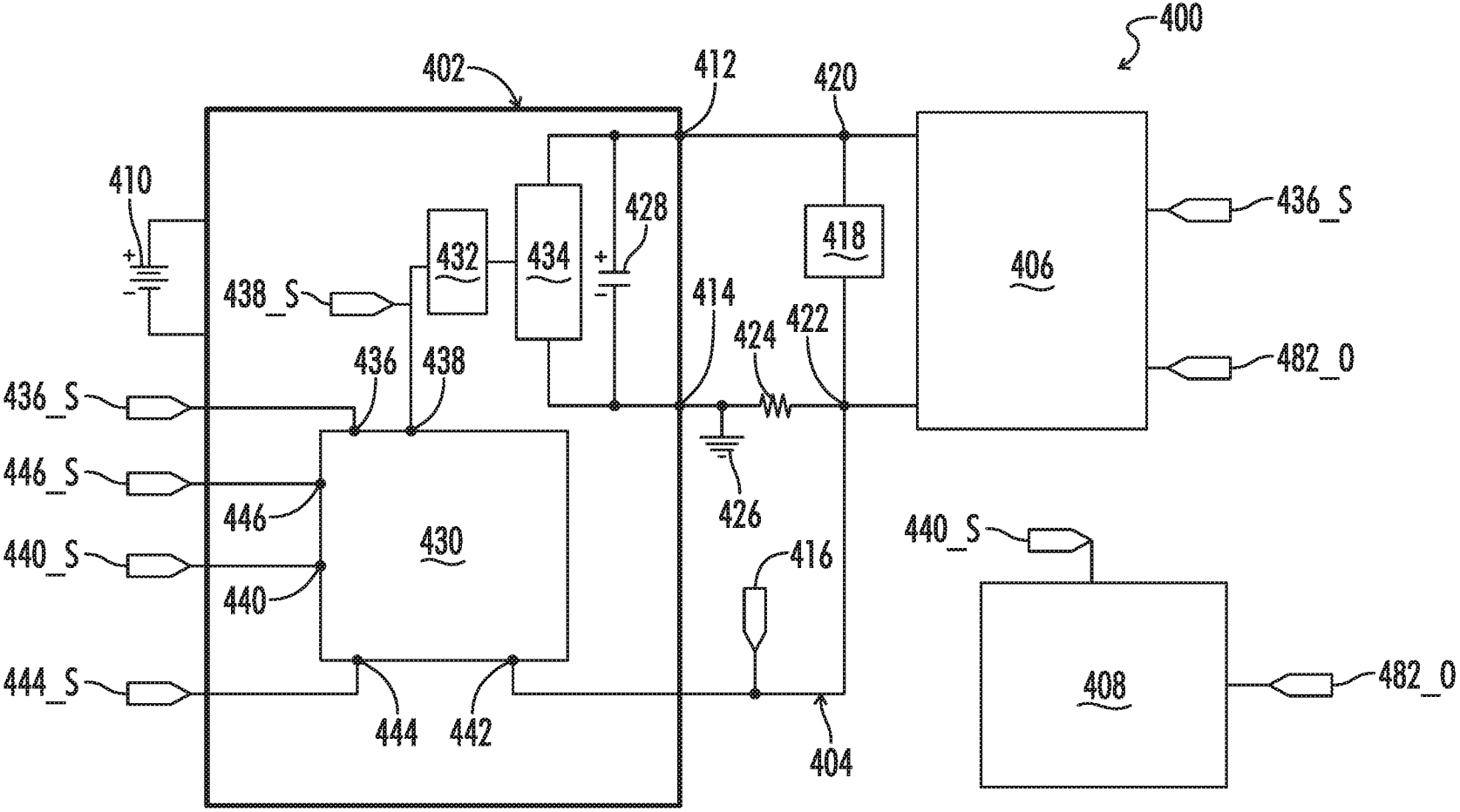
FIG. 5 is a circuit block diagram representing an exemplary LED driver circuit for lossless fast light modulating control in accordance with aspects of the present disclosure.
Figure 6:
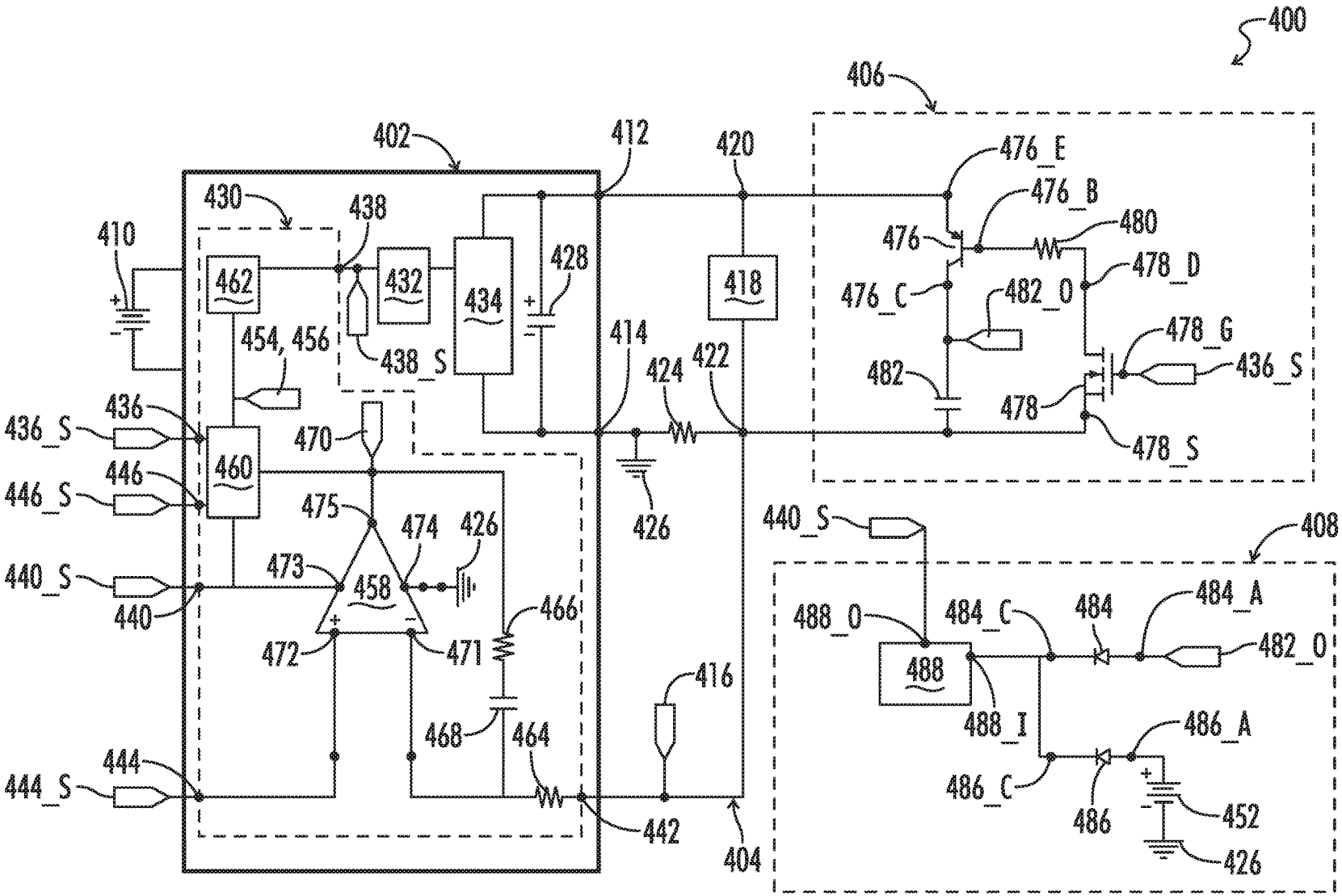
FIG. 6 is a circuit block diagram representing the LED driver circuit of FIG. 5 with detailed circuit elements.

Referring generally to FIGS. 5 and 6, exemplary light emitting diode (LED) drivers, light fixtures, and methods for fast and lossless light modulating control are now illustrated in greater detail. An exemplary LED driver 400 may be referred to as embodying or otherwise embodied by an LED lighting device 400. The LED driver 400 includes a power converter circuit 402, a feedback loop 404, a buffer circuit 406, and an energy recovery circuit 408. The feedback loop 404 may also be referred to herein as a current sensing feedback loop 404. The term "circuit" as used herein may mean at least either a single component or a multiplicity of components, either active and/or passive, that are coupled together to provide a desired function.

The power converter circuit 402 is coupled to a first voltage source 410. The first voltage source 410 is a direct-current (DC) voltage source, as an output from a DC energy storage device, a bridge rectifier, power factor correction (PFC) circuit, or the like. The power converter circuit 402 includes a first output terminal 412 and a second output terminal 414. The power converter circuit 402 is configured to provide an output current 416 to an LED load 418. The output current 416 may also be referred to herein as a sensed output current 416 or a reference output current 416. The LED load 418 includes a first end 420 and a second end 422. The first end 420 of the LED load 418 is coupled to the first output terminal 412. The LED load 418 is coupled in series with a current sensing resistor 424 between the first output terminal 412 and the second output terminal 414. The current sensing resistor 424 is configured to sense the output current 416 passing through the LED load 418. The output current 414 is measured at the second end 422 of the LED load 418. The sensed output current 414 is fed back through the feedback loop 404 to the power converter circuit 402. The second output terminal 414 of the power converter circuit 402 is coupled to earth ground 426. The power converter may further include an output capacitor 428 coupled between the first and second output terminals 412, 414 and is accordingly configured to store energy from the power converter circuit 402. It should be noted that whereas the current sensing resistor 424 is illustrated as being coupled between a second output terminal 414 of the power converter and a second end of the load 418, the current sensing resistor 424 or equivalent current sensor 424 could be defined within or otherwise in association with the power converter, such that the first and second ends 420, 422 of the load may comprise first and second output terminals of the power converter.

The power converter circuit 402 includes a controller 430, a switching circuit 432, and a power tank 434. The switching circuit 432 is coupled between the controller 430 and the power tank 434. The power tank 434 may either be frequency controlled type (i.e. a half-bridge type) or duty-ratio controlled type (i.e., a buck, boost, or flyback type). The power tank 434 is configured to produce a constant output current at its first and second output terminals 412, 414.

The term "controller" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The controller 430 may include a buffer control output terminal 436, a gate drive output terminal 438, a power input terminal 440, an output current feedback input terminal 442, an input current reference input terminal 444, and a modulation control input terminal 446. The buffer control output terminal 436 is coupled to the buffer circuit 406. The controller 430 is configured to selectively enable and disable a buffer control signal 436_S to the buffer circuit 406 at the buffer control output terminal 436.

The gate drive output terminal 438 is coupled to the switching circuit 432. The controller 430 is configured to selectively enable and disable gate drive signals 438_S to the switching circuit 432 at the gate drive output terminal 438.

The power input terminal 440 is coupled to the energy recovery circuit 408. The energy recovery circuit 408 is configured to provide a voltage signal 440_S to the power input terminal 440 for powering the controller 430.

The output current feedback input terminal 442 is coupled to the feedback loop 404. The controller 430 is configured to receive and monitor the output current 416 through the LED load 418 at the output current feedback input terminal 442.

The input current reference input terminal 444 is configured to receive a reference input current 444_S. The reference input current 444_S may also be referred to herein as an input current reference signal 444_S. The reference input current 444_S may for example be provided from an external dimming control device, a local user interface, one or more sensors, a lighting management system, or the like. The controller 430 is configured to monitor both the reference input current 444_S and the sensed output current 416.

Figure 8:
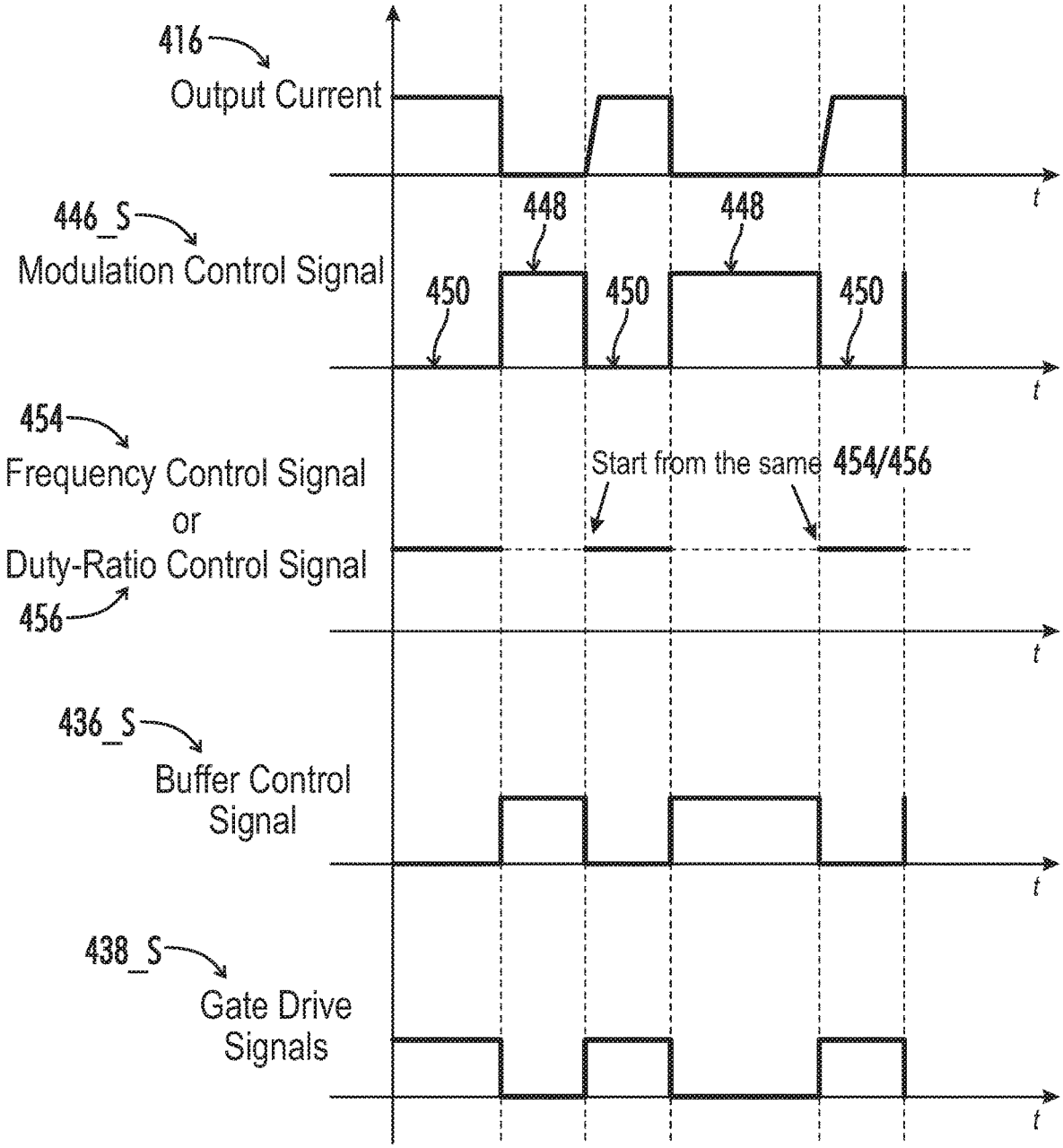
FIG. 8 is a graphical diagram representing a time-varying output current, modulation control command, frequency/duty-ratio, buffer state, and gate drive state for a modulating control sequence provided by the LED driver circuit of FIGS. 5 and 6.

The modulation control input terminal 446 is configured to receive a modulation control signal 446_S. The modulation control signal 446_S is associated with a modulation-on stage 448 (FIG. 8). The absence of the modulation control signal 446_S is associated with a modulation-off stage 450 (FIG. 8). The buffer control signal 436_S is enabled in the modulation-on stage 448 to enable the buffer circuit 406. The buffer control signal 436_S is disabled in the modulation-off stage 450 to short circuit the buffer circuit from the LED system 400. The gate drive signals 438_S are disabled in the modulation-on stage to disable the power tank 434 and stop any further transfer of energy from the power converter circuit to both the output capacitor 428 and the buffer circuit 406. The gate drive signals 438_S are enabled in the modulation-off stage to enable the power tank 434.

The buffer circuit 406 is coupled in parallel with the LED load 418 between the first end 420 and the second end 422 of the LED load 418. The buffer circuit 406 is responsive to the buffer control signal 436_S from the controller 430 to short-circuit the LED load 418 and temporarily store energy from the output capacitor 428.

The energy recovery circuit 408 is configured to power the controller 430 via the voltage signal 440_S from a selected one of the buffer circuit 406 and a second voltage source 452 of the energy recovery circuit 408. The reuses the energy being temporarily stored in the buffer circuit 406 first to thereby reduce circuit losses due to modulation and increase efficiency. Energy from the buffer circuit 406 is utilized to power the controller 430 until depleted to a predetermined threshold voltage. Once the buffer circuit has been depleted to the predetermined threshold voltage, the second voltage source 452 is utilized to power the controller 430. The predetermined threshold voltage is substantially equal to a voltage of the second voltage source 452.

The controller 430 may be configured to compare the reference input current 444_S with the sensed output current 416 to calculate either a frequency control signal 454 or a duty-ratio control signal 456. The frequency control signal 454 and the duty-ratio control signal 456 may be stored on the controller before being transmitted to either the switching circuit 432 or the power tank 434. At least one of the frequency control signal 454 and the duty-ratio control signal 456 is transmitted with the gate drive signals 438_S to the switching circuit 432 and the power tank 434. The gate drive signals 438_S may include the frequency control signal 454 and the duty-ratio control signal 456. The power tank is response to either the frequency control signal 454 or the duty-ratio control signal 456 depending on the type of power tank 434 used, as described above, to control the output current 416.

As shown in FIG. 6, for example, the controller 430 includes an operational amplifier (OPAMP) 458, a logic core 460, a gate drive circuit 462, a first controller resistor 464, a second controller resistor 466, and a controller capacitor 468. The OPAMP 458 is coupled to the power input terminal 440 and the input current reference input terminal 444. The OPAMP 458 is configured to produce an error voltage signal 470 based on the output current 416 through the LED load 418 relative to the reference input current 444_S. The logic core 460 is coupled to the buffer control output terminal 436, the power input terminal 440, the modulation control input terminal 446, the OPAMP 458, and the gate drive circuit 462. The logic core 460 is configured to store and convert the error voltage signal 470 into at least one of the frequency control signal 454 and the duty-ratio control signal 456. The logic gate 460 may further be configured to transmit the buffer control signal 436_S. The gate drive circuit 462 is coupled between the logic core 460 and the gate drive output terminal 438. The gate drive circuit 462 may be configured to disable the switching circuit 432 in the modulation-on stage 448 and enable the switching circuit in the modulation-off stage 450.

The OPAMP 458 includes an inverting input terminal 471, a non-inverting input terminal 472, a positive supply voltage terminal 473, a negative supply voltage terminal 474, and an output terminal 475. The first controller resistor 464 is coupled between the inverting input terminal 471 and the output current feedback input terminal 442. The first controller capacitor is coupled in series with the second controller resistor between the inverting input terminal 471 and the output terminal 475. The output terminal 475 is coupled to the logic core 460 and is configured to generate the error voltage signal 470. The non-inverting input terminal 472 is coupled to the input current reference input terminal 444. The positive supply voltage terminal is coupled to the power input terminal 440. The negative supply voltage terminal 474 is coupled to earth ground 426.

As shown in FIG. 6, the buffer circuit 406 includes a first buffer switch 476, a second buffer switch 478, a buffer resistor 480, and a buffer capacitor 482. The first buffer switch 476 includes an emitter node 476_E, a base node 476_B, and a collector node 476_C. The second buffer switch 478 includes a drain node 478_D, a gate node 478_G, and a source node 478_S. The emitter node 476_E of the first buffer switch 476 is coupled to the first end 420 of the LED load 418. The buffer resistor 480 is coupled between the base node 476B of the first buffer switch 476 and the drain node 478_D of the second buffer switch 478. The buffer capacitor 482 is couple between the collector node 476_C of the first buffer switch 476 and the second end 422 of the LED load 418. The buffer capacitor 482 includes a buffer capacitor output terminal 482_O coupled to the power recovery circuit 408. The gate node 478_G of the second buffer switch 478 is coupled to the buffer control output terminal 436 of the controller 430. The source node 478_S of the second buffer switch 478 is coupled to the second end 422 of the LED load 418.

The buffer circuit 406 is controlled by the controller 430 of the power converter circuit 402. More specifically, the second buffer switch 478 is controlled by the controller 430. When the controller 430 receives a modulation control signal 446_S (i.e., the modulation-on stage 448), it will enable the buffer control signal 436_S at the buffer control output terminal 436 to enable (i.e., turn on) the second buffer switch 478. When the second buffer switch 478 is enabled, a base current of the first buffer switch 476 will be enabled (i.e., turned on) through the buffer resistor 480 and as a result the first buffer switch 476 will be enabled. Energy stored in the output capacitor 428 will be dumped into the buffer capacitor 482 very quickly for storage. The buffer capacitor 482 has a capacitance designed to be large enough, for example, at least five to ten times larger than the capacitance of the output capacitor 428, though not limited to this range, in order for the initial turn on of the buffer circuit 406 to operate as a short-circuit on the output capacitor 428 and the LED load 418. As a result, the LED load 418 will be turned off fast and energy in the output capacitor 428 will be transferred to the buffer capacitor 482, and a new voltage balance will be established according to the following equation:

$$V_{new} = \frac{c_{out} \times V_{old}}{c_{out} + c_{buffer}}$$

where $V_{new}$ is the voltage after the buffer circuit is on, $V_{old}$ is the voltage before the buffer circuit is on, $C_{out}$ is the capacitance of the output capacitor 428, and $C_{buffer}$ is the capacitance of the buffer capacitor 482. As can be seen, $V_{new}$ is always smaller than Void. For example, if the buffer capacitor 482 has a capacitance five times larger than the capacitance of the output capacitor 428, then $$V_{new} = \frac{1}{6} \times V_{old}.$$

As shown in FIG. 6, the energy recovery circuit 408 includes the second voltage source 452, a first diode 484, a second diode 486, and a voltage regulator 488. The first diode 484 includes an anode 484_A and a cathode 484_C. The second diode 486 includes an anode 486_A and a cathode 486_C. The voltage regulator 488 includes at least one voltage regulator input 488_I and at least one voltage regulator output 488_O. The second voltage source 452 is coupled between the anode 484_A of the first diode 484 and earth ground 426. The anode 486_A of the second diode 486 is coupled to the buffer capacitor 482 at the buffer capacitor output terminal 482_O. Both cathodes 484_C, 486_C are coupled to the at least one voltage regulator input 488_I of the voltage regulator 488. The at least one voltage regulator output 488_O of the voltage regulator 488 is coupled to the power input terminal 440 of the controller 430. As shown in FIG. 6, for example, the voltage signal 440_S from the voltage regulator 488 powers at least the positive supply voltage terminal 473 of the OPAMP 458 and logic core 460. The voltage regulator 488 may supply power via the voltage signal 440_S to any other control circuits which may be implemented.

As a result of this configuration, all power stored in the buffer capacitor 482 is redirected to the energy recovery circuit 408 to be recycled in response to the modulation-off stage 450. The energy recovery circuit 408 selectively applies energy from either the buffer capacitor 482 of the buffer circuit 406 or the second voltage source 452 of the energy recovery circuit 408. The energy is applied to at least the OPAMP 458 of the controller 430 and the logic core 460. Energy from the buffer capacitor 482 is utilized until a voltage of the buffer capacitor 482 is discharged to a predetermined threshold voltage. The predetermined threshold voltage is equal to a voltage of the second voltage source 452. As previously mentioned, energy from the second voltage source 452 is utilized once the voltage of the buffer capacitor 482 falls below the predetermined threshold voltage (i.e., the voltage of the second voltage source). As a result, power stored in the buffer capacitor 482 is recycled during the modulation-off stage 450.

Figure 7:
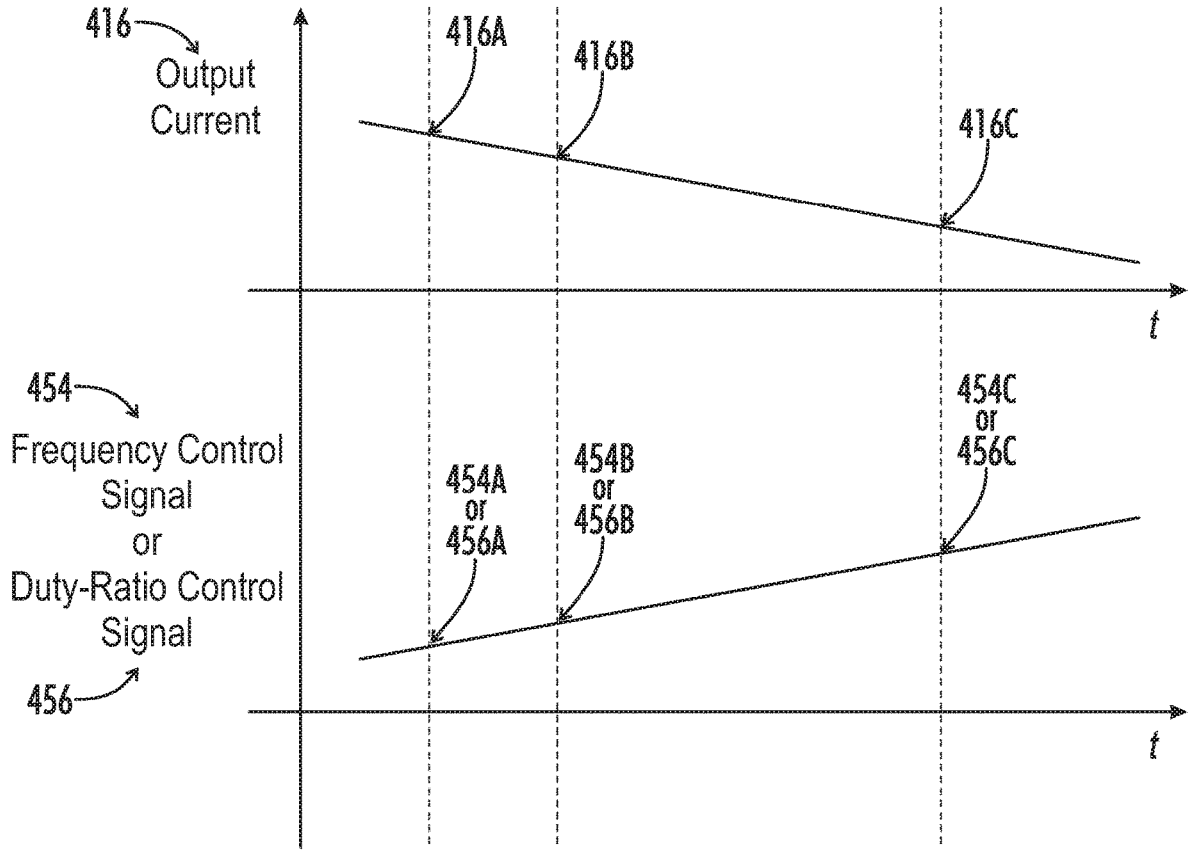
FIG. 7 is a graphical diagram representing the time-varying output current and frequency/duty-ratio provided by the LED driver circuit of FIGS. 5 and 6.

In an exemplary embodiment, the controller 430 may be configured generate the error voltage signal 438 based on the output current 416 through the LED load 418 relative to the reference input current 444_S. The controller 430 may be configured to remember and store the error voltage signal 438 at any time, especially just prior to the modulation control signal 446 and associated modulation-on stage 448. As shown in FIG. 7, each output current 416 of the LED load 418 is associated with a different frequency control signal 454 and/or duty-ratio control signal 456. FIG. 7 includes a first output current 416A associated with first frequency and duty-ratio control signals 454A, 456A, a second output current 416B associated with second frequency and duty-ratio control signals 454B, 456B, and a third output current 416C associated with third frequency and duty-ratio control signals 454C, 456C. The controller 430 may further be configured to store these associations, thereby allowing the controller 430 to easily convert the error voltage signal into either the frequency control signal 454 or the duty-ratio control signal 456.

The controller 430 is configured to restart the switching circuit 432 and the power tank 434 at the end of the modulation-on stage with either the frequency control signal 454 or the duty-ratio control signal 456 equal to or slightly less the value stored just prior to the modulation on-stage 448. As a result, when the modulation-off stage 450 starts, the output current 416 through the LED load 418 will immediately start from the same or similar output current 416 prior to the modulation-on stage 448. This configuration minimizes turn-on time and overshoot, two issues previously discussed above.

In other exemplary embodiments, as shown in FIG. 6, the logic core 460 may perform all of the previously mentioned functions of the controller 430.

Referring to FIG. 8, a waveform is provided summarizing an exemplary sequence of modulation control signals 446 in accordance with embodiments as disclosed herein. The chart varies with time and simultaneously displays: (1) the output current 416 of the LED load 418, (2) the modulation control signal 446, (3) the frequency and/or duty-ratio control signals 454, 456, (4) whether the buffer control signal 436_S is enabled, and (5) whether the gate drive signal 438_S is enabled.

Figure 9:
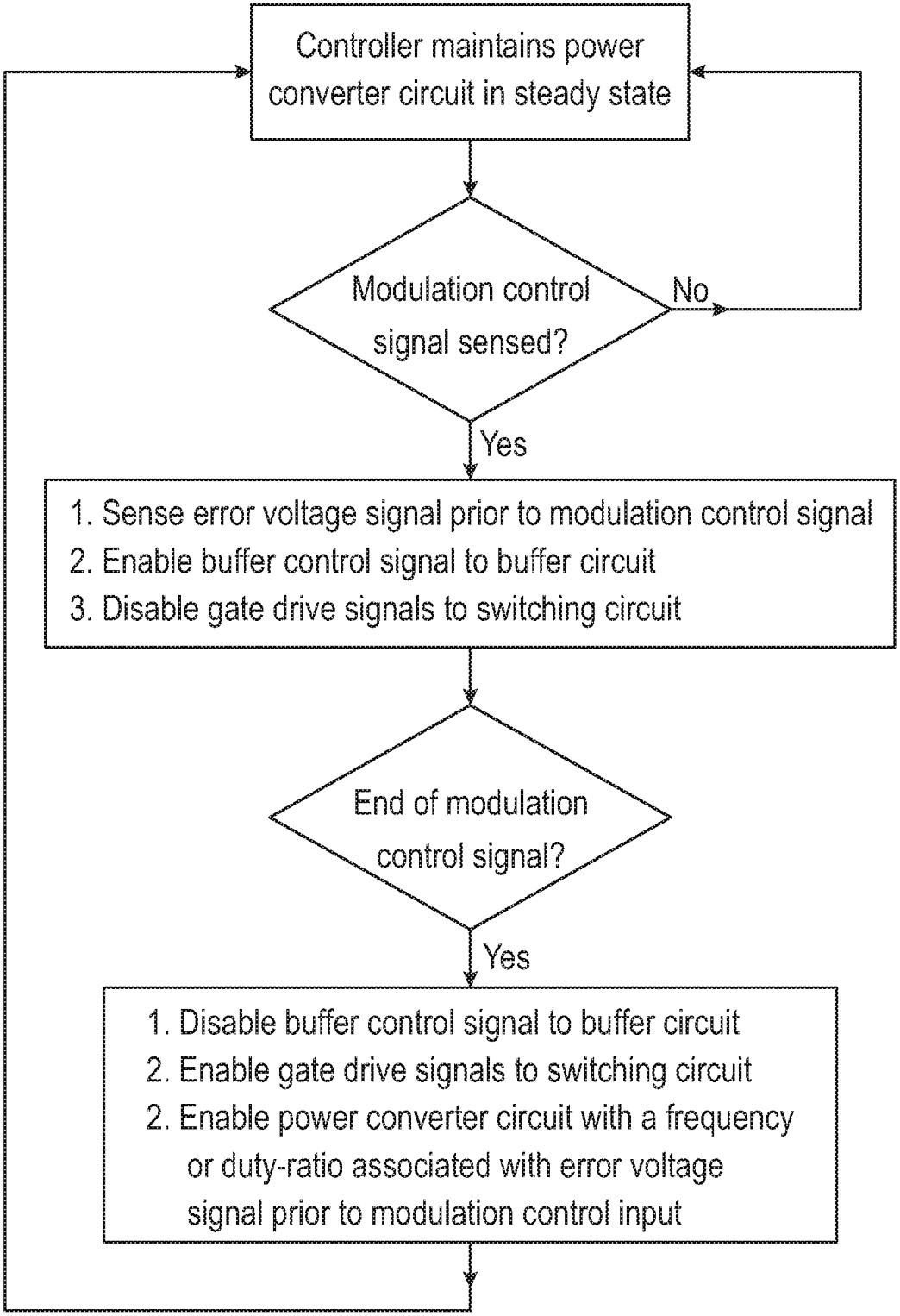
FIG. 9 is a flowchart representing an exemplary control process for a controller of the LED driver of FIGS. 5 and 6.

Referring to FIG. 9, an exemplary control flowchart for the controller 430 is shown in accordance with embodiments as disclosed herein. The flowchart depicts a method of controlling light modulation of a constant current LED driver. The method includes the step sensing a modulation control signal 446. In response to the modulation control signal 446, the controller 430 will begin to function responsive to the modulation-on stage 448. In the modulation-on stage 448, the method includes the step of generating an error voltage signal 470 by comparing a reference input current 444_S to an output current 416. In the modulation-on stage 448, the method further includes the step of converting the error voltage signal 470 prior to the sensed modulation-on stage 448 into at least one of a frequency control signal 454 and a duty-ratio control signal 456. In the modulation-on stage 448, the method may further include the step of storing the frequency control signal 454 and/or the duty-ratio control signal 456 converted from the error voltage signal 470 prior to the sensing modulation-on stage 448. In the modulation-on stage 448, the method further includes the step of enabling buffer control signals 436_S to a buffer circuit 406 to enable the buffer circuit 406. The enabled buffer circuit 406 is configured to short-circuit a LED load 418 coupled across an output 412, 414 of a power converter circuit 402 and also absorbs the energy stored in an output capacitor 428 also coupled across the output 412, 414 of the power converter circuit 402. In the modulation-on stage 448, the method further includes the step of disabling gate drive signals 438_S to a switching circuit 432 of the power converter circuit 402 to disable the switching circuit 432 and a power tank 434 of the power converter circuit 402. The disabled power tank 434 halts any further transfer of energy from the power converter circuit 402 to the output capacitor 428 and the buffer circuit 406.

In response to the end of the modulation-on stage (i.e., the absence of further modulation control signals 446) the controller 430 will begin to function responsive to the modulation-off stage 450. In the modulation-off stage 450, the method includes the step disabling the buffer control signal 436_S to the buffer circuit 406 to disable the buffer circuit 406. In the modulation-off stage 450, the method further includes the step enabling the gate drive signals 438_S to the switching circuit 432 to enable the power tank 434 with at least one of the frequency control signal 454 and the duty-ratio control signal 456 converted from the error voltage signal 470 prior to the sensed modulation-on stage 448.

In certain embodiments, the method may include the steps of: directing energy from the buffer circuit 406 into an energy recovery circuit 408, supplying energy from the buffer circuit 406 to the controller 430 until the buffer capacitor is discharged to a predetermined threshold voltage, and supplying energy from a second voltage source 452 of the energy recovery circuit 408 once the buffer circuit 406 has been discharged to the predetermined threshold voltage.

In certain embodiments, the method may include the steps of maintaining a steady state operation of the power converter circuit 402 in response to the modulation-off stage. When the reference input current 444_S changes, the error voltage signal 470 correspondingly changes. The controller 430 will converts the error voltage signal into either a frequency control signal 454 or a duty-ratio control signal 456 which will be fed into at least one of the switching circuit 432 and the power tank 434 in order to regulate the output current 416 to be the same as the reference input current.

In certain embodiments when operating in the steady state, the method may include the steps of: continuously monitoring for an error voltage signal 470, converting the error voltage signals 470 into at least one of the frequency control signal 454 and the duty-ratio control signal 456, and transmitting at least one of the frequency control signal 454 and the duty-ratio control signal 456 to at least one of the switching circuit 432 and the power tank 434 to control the output current 416.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An LED system for light modulation control, the LED system comprising:

a power converter circuit configured to provide a constant current output and comprising first and second output terminals, a power tank circuit, a switching circuit, and a gate drive controller, wherein the gate drive controller is configured to receive various inputs and selectively enable or disable gate drive signals to the switching circuit;

a buffer circuit coupled across the first and second output terminals of the power converter circuit, the buffer circuit responsive to a buffer circuit signal from the gate drive controller to selectively store energy from an output capacitor coupled across the first and second output terminals of the power converter circuit; and an energy recovery circuit configured to power the gate drive controller from a selected one of the buffer circuit and a second voltage source of the energy recovery circuit.

2. The LED system of claim 1, wherein the gate drive controller is configured to receive a modulation control input, a reference input current, and a reference output current, the modulation control input associated with a modulation-on stage, wherein the absence of the modulation control input is associated with a modulation-off stage, and wherein the reference output current is measured at one end of a load coupled to the first and second output terminals of the power converter circuit.

3. The LED system of claim 2, wherein:

the gate drive signals are disabled in the modulation-on stage to disable the power tank and stop further transfer of energy from the power converter circuit to the output capacitor and the buffer circuit; and the gate drive signals are enabled in the modulation-off stage to enable the power tank.

4. The LED system of claim 2, wherein the buffer circuit signal is enabled in the modulation-on stage and disabled in the modulation-off stage.

5. The LED system of claim 2, wherein:

the gate drive controller compares the reference input current with the reference output current to produce at least one of a frequency control signal and a duty-ratio control signal; and at least one of the frequency control signal and the duty-ratio control signal is transmitted to the switching circuit to control the reference output current.

6. The LED system of claim 1, wherein:

a load is coupled in series with a current sensing resistor between the first and second output terminals of the power converter circuit; and a reference output current measured by the current sensing resistor is fed back to the controller.

7. The LED system of claim 1, wherein the buffer circuit includes a buffer capacitor coupled to at least one buffer switch, the at least one switch enabled in response to receiving the buffer circuit signal from the controller;

the buffer circuit operates as a short-circuit on a load and the output capacitor in response to the modulation-on stage; and the buffer capacitor stores energy discharged from the output capacitor in response to the modulation-on stage.

8. The LED system of claim 7, wherein the buffer capacitor is at least five times the capacitance as the output capacitor.

9. The LED system of claim 1, wherein:

the energy recovery circuit is configured to selectively apply energy from either a buffer capacitor of the buffer circuit or the second voltage source to the controller;

energy from the buffer capacitor is utilized until depleted to a predetermined threshold voltage; and energy from the second voltage source is utilized once the buffer capacitor is discharged to the predetermined threshold voltage.

10. The LED system of claim 9, wherein the predetermined threshold voltage is substantially equal to a voltage of the second voltage source.

11. A method of controlling light modulation of a constant current LED driver comprising a power converter and an output capacitor coupled across output terminals thereof, said output terminals further configured to receive an LED load, the method comprising the steps of:

in a modulation-on stage corresponding to a sensed modulation control input:

generating an error voltage signal by comparing a reference input current to a sensed output current from the power converter circuit;

converting the error voltage signal prior to the sensed modulation-on stage into at least one of a frequency control signal and a duty-ratio control signal;

enabling buffer control signals to a buffer circuit based upon the sensed modulation-on stage to short-circuit the load and absorb energy from the output capacitor; and disabling gate drive signals to a switching circuit of the power converter circuit to disable a power tank of the power converter circuit in order to halt further transfer of energy from the power converter circuit to the output capacitor and the buffer circuit;

in a modulation-off stage corresponding to an absence of the modulating control input:

disabling buffer control signals to the buffer circuit based on the modulation-off stage to disable the buffer circuit; and enabling gate drive signals to the switching circuit to enable the power tank with at least one of the frequency control signal and the duty-ratio control signal converted from the error voltage signal prior to the sensed modulation-on stage; and maintaining a steady state operation in response to the modulation-off stage, comprising:

continuously monitoring for an error voltage signal by comparing the reference input current to the reference output current;

converting the error voltage signal into at least one of a frequency control signal and a duty-ratio control signal; and transmitting at least one of the frequency control signal and the duty-ratio control signal to at least one of the switching circuit and the power tank to control the reference output current.

12. The method of claim 11, where the method further comprises the steps of:

directing energy from the buffer circuit into an energy recovery circuit, the energy recovery circuit having an auxiliary energy source;

supplying energy to at least the controller from the buffer capacitor until discharged to predetermined threshold voltage; and supplying energy to at least the controller from the auxiliary energy source once the buffer capacitor is discharged below the predetermined threshold voltage.

13. A light fixture with light modulating control, the light fixture comprising:

a first voltage source configured to provide an input current;

a power converter circuit coupled across the first voltage source and configured to provide a constant current output to first and second output terminals of the power converter circuit, the power converter circuit having a power tank circuit, a switching circuit, and a controller, the controller configured to receive various inputs and selectively enable or disable gate drive signals to the switching circuit;

a light emitting diode (LED) load coupled across the first and second output terminals of the power converter circuit;

a current sensing feedback loop coupled between the LED load and the controller, the controller configured to monitor an output current of the LED load;

a buffer circuit coupled in parallel with the LED load, the buffer circuit responsive to a buffer circuit signal from the controller to short-circuit the LED load and selectively store energy from an output capacitor coupled across the first and second output terminals of the power converter circuit; and an energy recovery circuit configured to power the controller from a selected one of the buffer circuit and a second voltage source of the energy recovery circuit based on a predetermined threshold voltage.

14. The light fixture of claim 13, wherein:

the controller includes a buffer control output terminal, a gate drive output terminal, a power input terminal, an output current feedback input terminal, an input current reference input terminal and a modulation control input terminal;

the buffer control output terminal coupled to the buffer circuit;

the gate drive output terminal coupled to the switching circuit;

the power input terminal coupled to an output of the energy recovery circuit;

the output current feedback input terminal coupled to the LED load;

the input current reference input terminal configured to receive an input current reference signal; and the modulation control input terminal configured to receive a modulation control input associated with a modulation-on stage, the absence of the modulation control input associated with a modulation-off stage.

15. The LED driver of claim 14, wherein:

the controller includes an operational amplifier (OPAMP), a logic core, a gate drive circuit, a first controller resistor, a second controller resistor, and a controller capacitor;

the OPAMP is coupled to the power input terminal, the output current feedback input terminal, and the input current reference input terminal, the OPAMP configured to produce an error voltage signal at an output terminal based on the output current through the LED load relative to the input current reference signal;

the logic core is coupled to the power input terminal, the modulation control input terminal, the buffer control output terminal, the output terminal of the OPAMP, and the gate drive circuit, the logic core configured to convert the error voltage signal into at least one of a frequency control signal and a duty-ratio control signal; and the gate drive circuit is coupled between the logic circuit and the gate drive output terminal, the gate drive circuit configured to disable the switching circuit in the modulation-on stage and enable the switching circuit in the modulation-off stage.

16. The LED driver of claim 15, wherein:

the OPAMP includes an inventing input terminal, a non-inverting input terminal, a positive supply voltage terminal, a negative supply voltage terminal, and the output terminal;

the first controller resistor is coupled between the inverting input terminal and the output current feedback input terminal;

the first controller capacitor and second controller resistor are coupled in series between the inverting input terminal and the output terminal;

the output terminal is coupled to the logic core and is configured to generate the error voltage signal;

the non-inverting input terminal is coupled to the input current reference input terminal;

the positive supply voltage terminal is coupled to the power input terminal; and the negative supply voltage terminal is coupled to earth ground.

17. The LED driver of claim 13, wherein:

the buffer circuit includes a first buffer switch, a second buffer switch, a buffer resistor, and a buffer capacitor, the first buffer switch having emitter node, a base node, and a collector node, the second buffer switch having drain node, a gate node, and a source node, the emitter node of the first buffer switch coupled to a first end of the LED load, the gate node of the second switch coupled to a buffer control output terminal of the controller, the source node coupled to a second end of the LED load;

the buffer resistor coupled between the base node of the first buffer switch and the drain node of the second buffer switch; and the buffer capacitor coupled between collector node of the first buffer switch and the second end of the LED load.

18. The LED driver of claim 13, wherein:

the energy recovery circuit includes the second voltage source, a first diode, a second diode, and a voltage regulator;

the first diode is coupled at an anode to the second voltage source and is coupled at a cathode to at least one voltage regulator input of the voltage regulator;

the second diode is coupled at an anode to the buffer circuit and is coupled at a cathode to the at least one voltage regulator input; and the voltage regulator having the at least one voltage regulator input and at least one voltage regulator output coupled to a power input terminal of the controller.

* * * * *